US010487994B2

(12) United States Patent
Bechter et al.

(10) Patent No.: US 10,487,994 B2
(45) Date of Patent: Nov. 26, 2019

(54) COVER FOR A LIGHTING STRIP SYSTEM, ARRANGEMENT HAVING SUCH A COVER, AND LIGHTING STRIP SYSTEM

(71) Applicant: ZUMTOBEL LIGHTING GMBH, Dornbirn (AT)

(72) Inventors: Wolfgang Bechter, Hittisau (AT); Martin Bader, Dornbirn (AT); Wolfgang Gadner, Horbranz (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 15/764,786

(22) PCT Filed: Aug. 24, 2016

(86) PCT No.: PCT/AT2016/060043
§ 371 (c)(1),
(2) Date: Sep. 18, 2018

(87) PCT Pub. No.: WO2017/054025
PCT Pub. Date: Apr. 6, 2017

(65) Prior Publication Data

US 2019/0017665 A1 Jan. 17, 2019

(30) Foreign Application Priority Data

Sep. 30, 2015 (DE) ..... 20 2015 105 153 U

(51) Int. Cl.
*F21S 4/20* (2016.01)
*F21V 3/02* (2006.01)
*F21V 21/005* (2006.01)
*H01R 13/447* (2006.01)

(52) U.S. Cl.
CPC .....
*F21S 4/20* (2016.01); *F21V 3/02* (2013.01); *F21V 21/005* (2013.01); *H01R 13/447* (2013.01)

(58) Field of Classification Search
CPC ..... F21S 4/20; F21V 21/005; F21V 21/008; F21V 21/02; F21V 23/001; F21V 3/02; F21V 3/00; F21V 3/04; H01R 13/447
See application file for complete search history.

(56) References Cited

U.S. PATENT DOCUMENTS

| | | | | |
|---|---|---|---|---|
| 4,891,737 | A | 1/1990 | Szymanek | |
| 9,611,991 | B2 | 4/2017 | Ladstaetter | |
| 10,267,502 | B2 * | 4/2019 | Abrina | F21V 23/007 |
| 2016/0069521 | A1 * | 3/2016 | Ladstaetter | F21V 3/0625 362/223 |

FOREIGN PATENT DOCUMENTS

| | | | |
|---|---|---|---|
| DE | 202006005920 | U1 | 6/2006 |
| DE | 202009015404 | U1 | 9/2010 |

(Continued)

*Primary Examiner* — Joseph L Williams
*Assistant Examiner* — Jose M Diaz
(74) *Attorney, Agent, or Firm* — Volpe and Koenig, P.C.

(57) ABSTRACT

The invention relates to a cover for covering a light outlet opening (4) limited by a support rail (1) of a lighting strip system, the support rail (1) being designed to receive a lamp (2) having a light source (3) for producing light, wherein the cover (5) has a holding device (6) for holding at least one optically active element (7) for influencing the light.

16 Claims, 5 Drawing Sheets

(56) References Cited

FOREIGN PATENT DOCUMENTS

| | | | |
|---|---|---|---|
| DE | 202013101775 | U1 | 7/2014 |
| DE | 102014204136 | A1 | 9/2015 |
| EP | 0669492 | A1 | 8/1995 |
| EP | 1195551 | A2 | 4/2002 |
| EP | 2042802 | A1 | 4/2009 |
| EP | 2239495 | A2 | 10/2010 |
| WO | 2012098507 | A1 | 7/2012 |
| WO | 2014174019 | A1 | 10/2014 |

* cited by examiner

Fig. 4
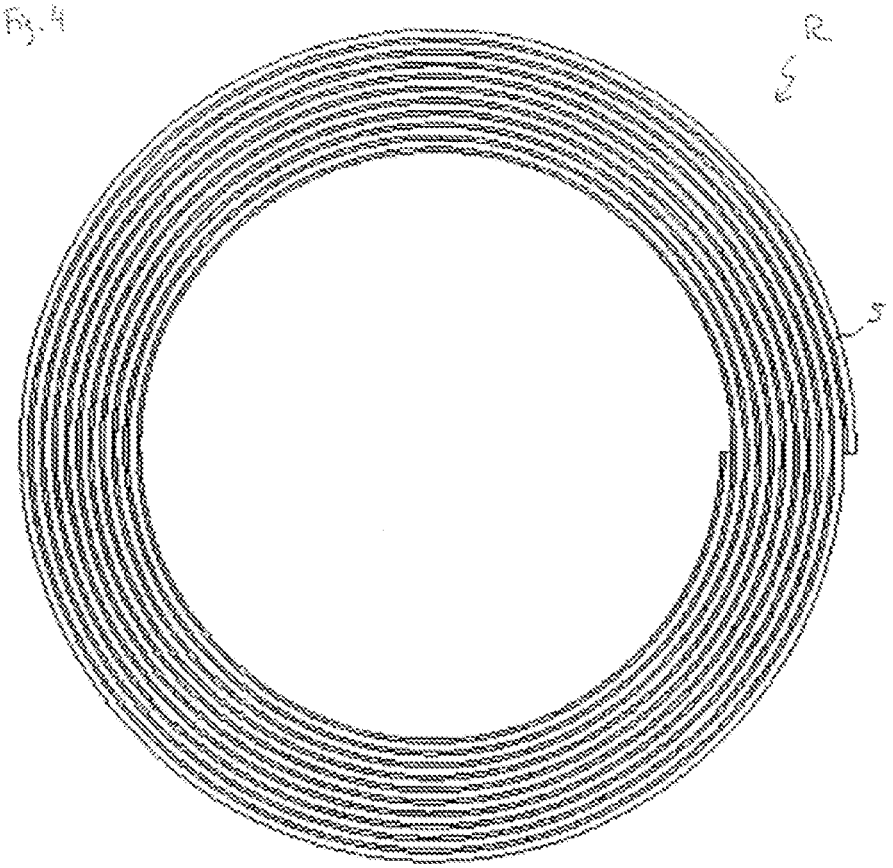
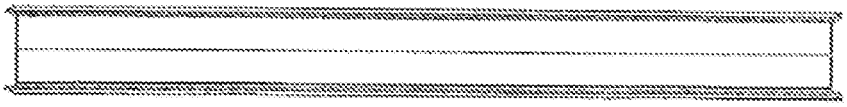
Fig. 5

- State of the art -

COVER FOR A LIGHTING STRIP SYSTEM, ARRANGEMENT HAVING SUCH A COVER, AND LIGHTING STRIP SYSTEM

INVENTIVE FIELD

The invention relates to a cover for covering a light outlet opening delimited by a support rail of a lighting strip system, the support rail being designed to receive a luminaire having a light source for producing light. Furthermore, the invention comprises an arrangement having a cover of this kind and an optically active element for influencing the light, and also a corresponding lighting strip system.

BACKGROUND

The applicant markets a lighting strip system of this kind under the trade name "SLOTLIGHT infinity". A schematic cross section through this lighting strip system is depicted in FIG. 6, said cross section showing a corresponding support rail 100 and also—only implied here—a luminaire 101 which is held in the support rail 100. The luminaire 101 has an LED light source 102 (LED=light-emitting diode) for producing light. A light outlet opening 103 for the light is delimited in this case by the support rail 100 which is covered using the light-permeable cover 104.

For assembly purposes, the cover 104 in this case can be rolled up into a roll and carried over a shoulder, for example, and unrolled bit by bit and connected to the support rail 100 in a latching manner, so that the light outlet opening 103 is increasingly covered. The optical properties of the cover 104 are defined in this case and are practically unchangeable.

A rollable profile part which is suitable for covering a channel is known from DE 10 2014 204 136 A1.

The problem addressed by the invention is that of specifying a corresponding improved cover, an arrangement which comprises a corresponding cover and an optically active element, and also a corresponding improved lighting strip system. In particular, the possibility should be opened up in this case for the cover to be modified in a particularly suitable manner with respect to the optical properties.

SUMMARY

This problem is solved according to the invention by means of the items referred to in the dependent claims. Particular embodiments of the invention are specified in the dependent claims.

According to the invention, a cover for covering a light outlet opening delimited by a support rail of a lighting strip system is provided, wherein the support rail is configured to receive a luminaire with a light source for producing light. The cover in this case has a holding device for holding at least one optically active element to influence the light.

By means of the holding device, the cover can be connected particularly easily and practicably to the optically active element. In this way, the light-output properties of the lighting strip system can be adjusted or also changed particularly easily and effectively.

The cover is preferably formed in a manner that can be rolled up into a roll and unrolled. Hence, it can be fitted comparatively easily—in particular, even when the cover comes in a long length; in this way, a long cover can be advantageously achieved without a join.

The cover preferably has a plate-shaped bearing region by means of which a particularly planar bearing surface for bearing the element is formed. Hence, the optically effective element can be particularly suitably positioned relative to the cover.

The cover is preferably configured to extend along a longitudinal axis, wherein it has a connection region for connecting to the support rail which abuts the bearing region on one side and extends parallel to the longitudinal axis, and wherein the holding device comprises a holding lip formed on the connection region. In this way, a particularly suitable fixing of the at least one optically active element can act on the cover.

In this case, the connection region is furthermore preferably made of a more flexible material than the bearing region. This makes it possible, in particular, for the cover to be connected to the support rail particularly easily and reliably when there is suitable inherent stability in the bearing region.

The holding lip is preferably configured directed at the bearing surface. In this way, a particularly suitable and reliable connection between the at least one optically effective element and the cover can be achieved.

The cover is preferably of symmetrical design in respect of a central plane extending parallel to the longitudinal axis and penetrating the bearing region, so that the cover has a further connection region with a corresponding further holding lip, said connection region being configured symmetrically to the aforementioned connection region. A particularly suitable and reliable arrangement of the optically effective element is also supported in this way.

The cover may be configured advantageously in production terms as a profile part.

The cover may be produced advantageously in production terms using a two-component injection-molding method.

The at least one optically effective element can be particularly suitably connected to the cover, if the cover is configured in such a manner that the at least one optically active element can be inserted or introduced into said cover for the anticipated connection thereto.

According to a further aspect of the invention, an arrangement is provided which comprises a cover according to the invention and the at least one optically active element, wherein the at least one optically active element is held on the cover by the holding device. This arrangement can be fitted particularly suitably to a corresponding support rail of a lighting strip system.

The optically active element is preferably a film, in particular a film which has an optically diffusing or light-directing effect.

Further preferably, in this case in particular the optically active element is arranged lying on the bearing surface, wherein it is positioned on two opposite sides by the holding lip and the other holding lip or arranged pressed against the bearing surface.

According to yet another aspect of the invention, a lighting strip system is provided which has a support rail extending along a longitudinal axis and also an elongate luminaire which is arranged in the support rail, wherein the luminaire has a light source for producing light and wherein a light outlet opening through which the light passes is delimited by the support rail. Furthermore, the lighting strip system has an elongate, light-permeable cover according to the invention extending along the longitudinal axis, which cover is arranged covering the light outlet opening.

BRIEF DESCRIPTION OF THE DRAWINGS

The invention is explained in greater detail below with the help of an exemplary embodiment and with reference to the drawings. In the drawings:

FIG. 4 shows a drawing of a cover according to the invention, rolled up into a roll, FIG. 5 shows a drawing of the roll from a different viewing angle.

DETAILED DESCRIPTION OF THE PREFERRED EMBODIMENTS

Figure 1:
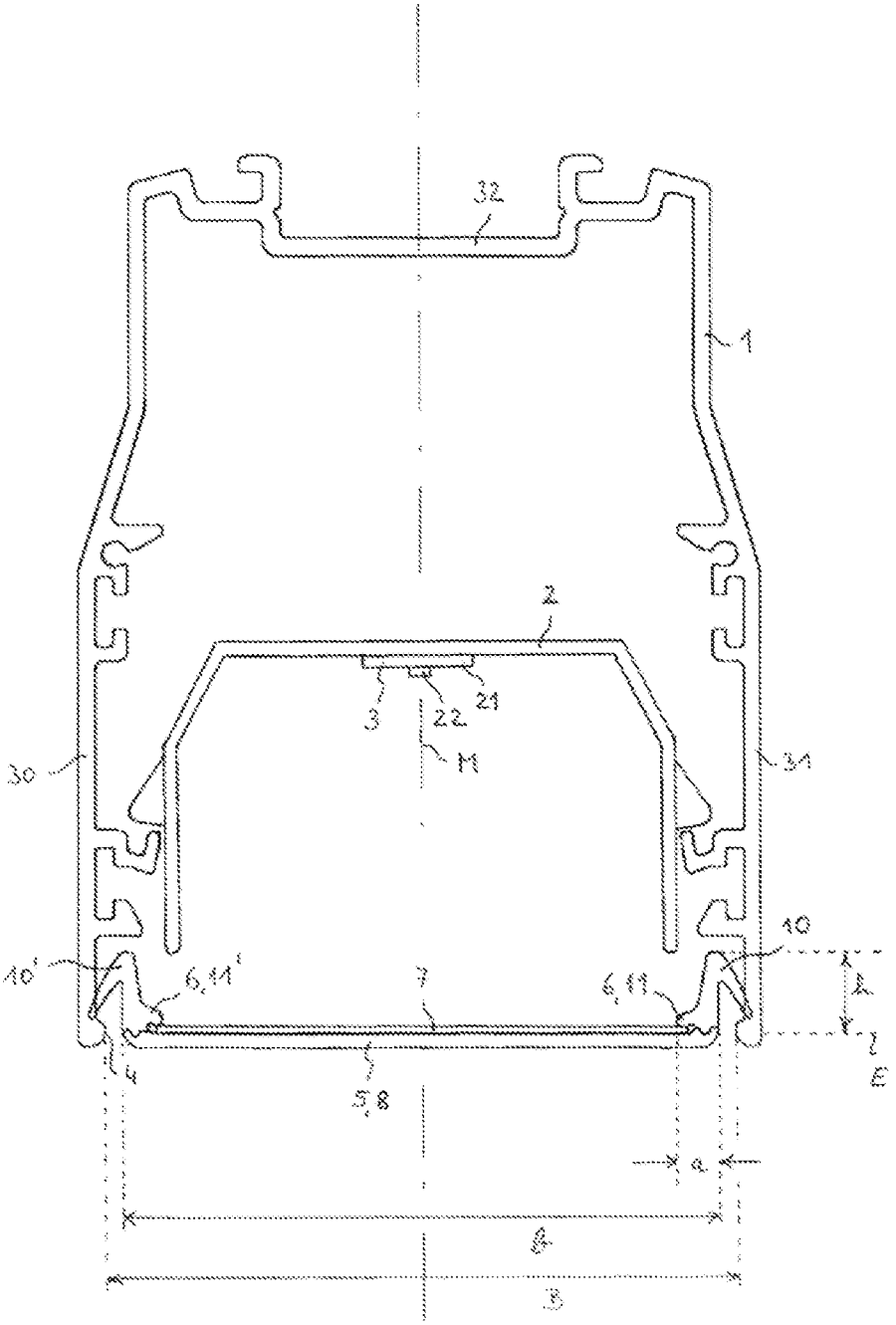
FIG. 1 shows a cross-sectional drawing through a lighting strip system according to the invention, wherein the support rail of the lighting strip system is covered by a cover according to the invention.

FIG. 1 shows a cross-sectional drawing through a lighting strip system according to the invention, wherein the lighting strip system has a support rail 1 extending along a longitudinal axis and a luminaire 2 arranged in the support rail 1—only implied here in very schematic form. FIG. 1 shows a cross section perpendicular to the longitudinal axis in this case.

In the example shown, the support rail 1 is configured in the manner of a profile and has a U-shaped cross section in a first approximation, so that a first U-shaped leg 30, a second U-shaped leg 31, and a connecting leg 32 connecting the two U-shaped legs 30, 31 to one another are formed. The luminaire 2 in this case is arranged between the two U-shaped legs 30, 31 of the support rail 1.

The luminaire 2 has a light source 3 for producing light; the light source 3 may be an LED light source, for example, which comprises a plate 21 and LEDs 22 arranged thereon. The LEDs 22 in this case are arranged in such a manner that they extend along a line parallel to the longitudinal axis, so that the light source is elongate overall and extends parallel to the longitudinal axis in this case.

A light outlet opening 4 from which the light escapes is delimited in this case by the support rail 1 or the two free end regions of the two U-shaped legs 30, 31. To this extent, the lighting strip system may be configured like the lighting strip system SLOTLIGHT infinity referred to above which is known in the art.

The support rail 1 generally has a greater extent along the longitudinal axis than the luminaire 2, meaning that it is longer than the luminaire 2. In particular, the support rail 1 may be configured in such a length that a plurality of corresponding luminaires can be arranged along the longitudinal axis forming a row in the support rail 1. A plurality of corresponding support rails which are each arranged with their ends abutting one another along the longitudinal axis may also be provided overall. In this way, it is in particular possible for very long "light strips" or "light lines" to be achieved by means of the lighting strip system; the length of a lighting strip of this kind may, for example, be up to 20 m in this case.

The light output opening 4 is covered using an at least partially light-permeable cover 5 according to the invention. In this case, the cover 5 has a holding device 6 for holding at least one optically active element 7 for influencing the light. The optically active element 7 may be a film, for example, for instance a film which has an optically diffusing or light-directing effect.

The cover 5 is preferably configured in such a manner that it can be rolled up into a roll R—as depicted in FIG. 4—when it is separated from the support rail 1. In FIG. 5 the roll R is depicted from a different viewing angle. For fitting to the support rail 1, the cover 5 can be rolled up into the roll R, and carried over a shoulder, for example, and unrolled bit by bit and connected to the support rail 1 in a latching manner, so that the light outlet opening 4 is increasingly covered.

By connecting the cover 5 to the optically active element 7 with the help of the holding device 6, an arrangement according to the invention can be created. In this case, the configuration is, in particular, such that this arrangement, and also the cover 5 as such, can be rolled up or unrolled and handled. Accordingly, the at least one optically active element 7 is preferably of thin or flexible design, in such a manner that the arrangement can easily be rolled up into a roll, for example into a roll with a diameter of less than 1 m; this means that a suitably simple attachment of the arrangement to the support rail 1 is made possible.

Figure 3:
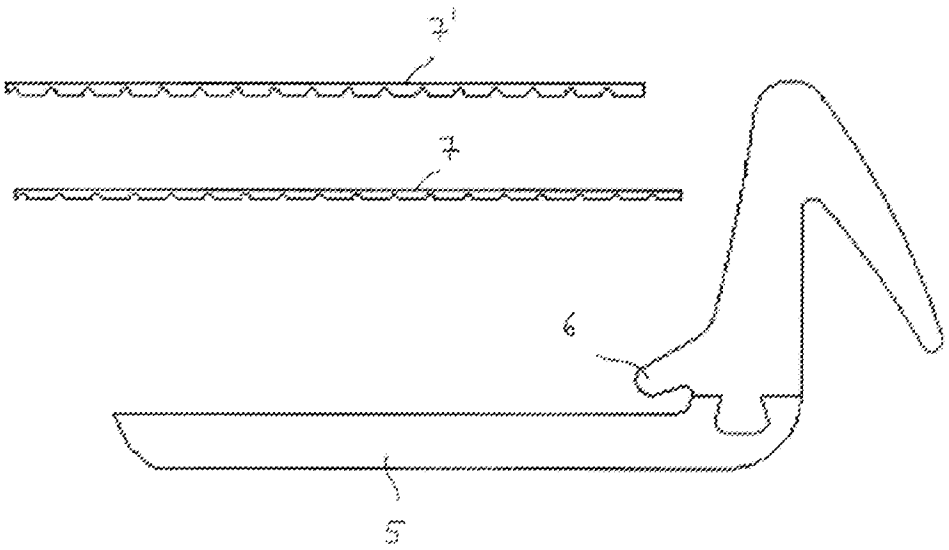
FIG. 3 shows a drawing corresponding to FIG. 2, wherein the optically active element is separate.
Figure 6:
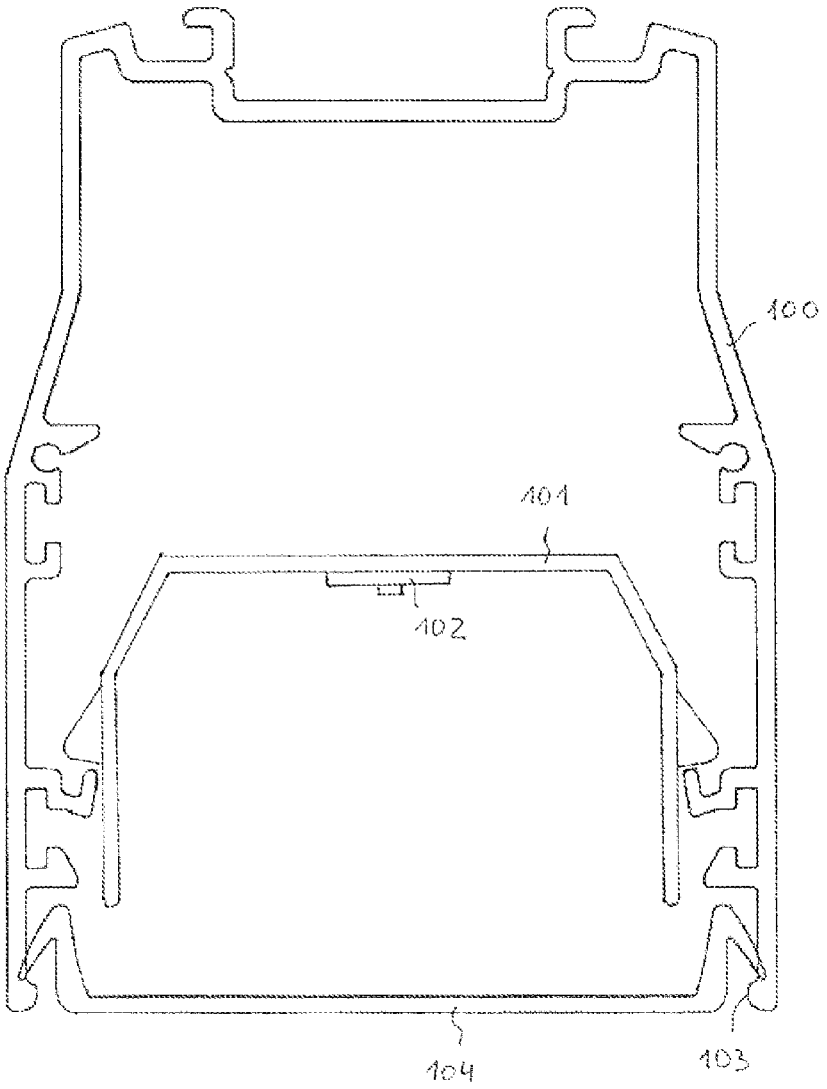
FIG. 6 shows a lighting strip system according to the state of the art.

A partial region of the separated cover 5 is depicted in cross section in FIG. 3. The support rail system preferably comprises a plurality of corresponding optically active elements 7, 7' which differ from one another in their optical properties, so that one of the elements 7, 7' may optionally be connected to the cover 5; in this way, it is easy to choose between different optical effects.

Figure 2:
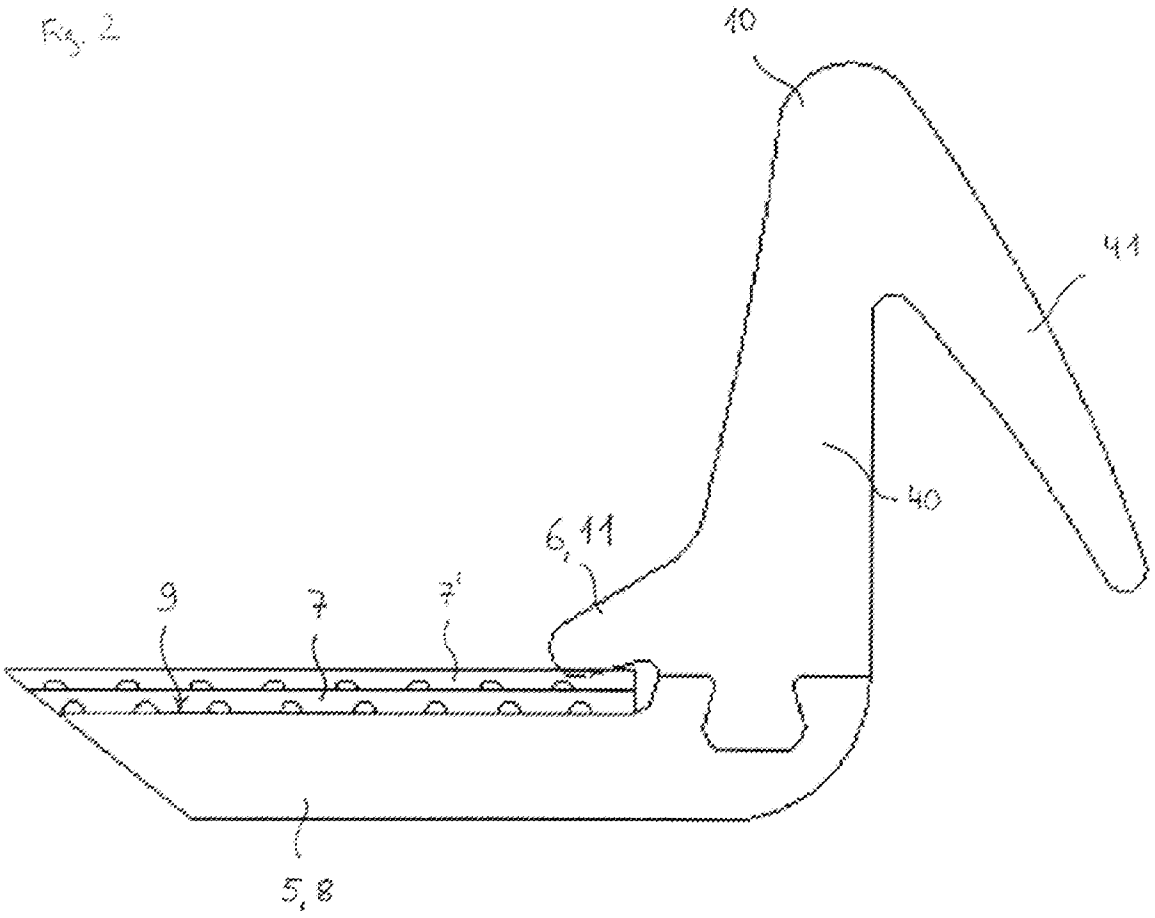
FIG. 2 shows a corresponding cross-sectional drawing around a connection region of the cover.

The configuration is furthermore particularly preferably such that—as depicted accordingly in FIG. 2—a plurality of, for example at least two, corresponding optically active elements 7, 7' can also be connected to the cover 5 with the help of the holding device 6, in other words at least two films laid one on top of the other, for example. This means that the possible optical property options are further increased.

For example, the optically active elements may be films of different materials and colors which are used to reduce glare, for example, and/or for adding focal points or similar.

As is the case in the example shown, the cover 5 preferably has a plate-like bearing region 8 by means of which a particularly planar bearing surface 9 is formed for the bearing of the element 7 or the at least one element 7. If the cover 5 is mounted on the support rail 1, as provided for, the plate-like supporting region 8 extends parallel to the longitudinal axis of the support rail 1. In particular, the bearing region 8 is configured, at least partially, in a light-permeable manner. Furthermore, the bearing region 8 is advantageously flexibly configured in this case in such a manner that it can be bent about a bending axis during the aforementioned rolling up and unrolling, said bending axis being oriented parallel to the bearing surface 9 and at right angles to the longitudinal extent of the cover 5.

A secure positioning of the optically active element 7 can be effected in a particularly suitable manner by the bearing surface 9 in respect of the cover 5.

In the mounted state the cover 5 extends overall along the longitudinal axis. In this case, it has on one side—on the right side with reference to FIG. 1—a connection region 10 which abuts the bearing region 8 and likewise extends parallel to the longitudinal axis for connecting to the support rail 1—in this case to the free end region of the second U-shaped leg 31 of the support rail 1.

In terms of production, the connection region 10 is advantageously preferably of profile-like design, wherein the profile axis—with the cover 5 in the mounted state—is oriented parallel to the longitudinal axis. As shown in FIG. 2, for example, the connection region 10 has a V-shaped cross section in a first approximation, for example, wherein a first V-shaped leg 40 abuts the bearing region 8 with its free end and a second V-shaped leg 41 is configured for locking connection to the free end region of the second U-shaped leg 31 of the support rail 1.

With reference to the aforementioned rollability of the cover 5, it is advantageous for the connection region 10 not to extend too far beyond a plane E which is defined by the bearing surface 9. For example, it may be provided that the connection region 10 has a height h with reference to this plane E to which the following applies in relation to a width b of the bearing region 8: h<0.30 b, preferably h<0.25 b, particularly preferably h<0.20 b. The width b may be less than 20 cm, for example, preferably less than 15 cm. The configuration in this case may furthermore be such that the width b is more than 80%, preferably more than 90%, of the width B of the light outlet opening 4.

The holding device 6 for holding the optically active element 7 comprises a holding lip 11 formed on the connection region 10. In particular, the holding lip 11 may be formed on the first V-shaped leg 40, namely on the side opposite the second V-shaped leg 41. In particular, the holding lip 11 is configured directed at the bearing surface 9.

Particularly suitable mechanical properties can be achieved if the connection region 10 is made of a more flexible material than the bearing region 8. This is, in particular, also advantageous with respect to rollability.

As can be seen from FIG. 1, the cover 5—viewed in the mounted state on the support rail 1—is furthermore preferably formed symmetrically with respect to a central plane M extending parallel to the longitudinal axis and penetrating the bearing region 8, so that the cover 5 has a further connection region 10' formed symmetrically with respect to the aforementioned connection region 10 with a further corresponding holding lip 11'. Hence, the optically active element 7 can be held in a suitably positioned manner on both sides with respect to the bearing surface 9. Accordingly, the further connection region 10' is configured in particular to connect to the free end region of the first U-shaped leg 31 of the support rail 1.

The embodiment described means that it is particularly possible for the at least one optically active element 7 not to jump out of its position or relative position provided in relation to the cover 5 in an unwanted manner during handling of the arrangement, for example during rolling or unrolling.

The embodiment is furthermore advantageously such that the at least one optically active element 7 is held by the holding device 6 on the cover 5, even if the cover 5 is not connected to the support rail 1. Hence, to produce the lighting strip system in a first step, the optical element 4 is connected to the at least one optical element 7 and the arrangement thereby formed is then mounted on the support rail 1 in a subsequent step.

The embodiment in this case is preferably configured in such a manner that the optically active element 7 rests on the bearing surface 9 and is positioned during this on two opposite sides by the holding lip 11 and the other holding lip 11' or is arranged pressed against the bearing surface 9.

The connection region 10 is configured to be light-impermeable, for example. Accordingly, it is advantageous with respect to a particularly large-area light output for the holding lip 11 not to extend too far onto the center plane M. For example, it may be provided that the holding lip 11 extends from the corresponding lateral delimitation of the bearing region 8 by a dimension a toward the center plane M, in other words inwards, wherein the following equation applies with respect to the width b of the bearing region 8: a<0.20 b, preferably a<0.15 b, particularly preferably a<0.10 b.

A particularly simple production possibility for the cover 5 is facilitated if the cover 5 is designed as a profile part; in particular, the cover 5 may be produced using a two-component injection-molding method. In this way, the two connection regions 10, 10' can be of more flexible design than the bearing region 8 in a particularly suitable manner.

The cover 5 or the arrangement described are suitable to a particular degree for an arrangement with long lengths. For example, lengths of up to 20 m may be provided for. This is particularly advantageous with regard to a lighting strip system which, as mentioned above, is designed for producing correspondingly long lighting strips. Through this embodiment, a correspondingly long cover can be produced without a join. The at least one optically active element 7 in this case is also preferably correspondingly long. In this way, a particularly uniform appearance of the lighting strip can be achieved overall.

In order to connect the at least one optically active element 7 to the cover 5, it may be provided in this case that the element 7 is threaded with respect to the longitudinal axis at one end region of the cover 5 between the bearing surface 9 and the two holding lips 11, 11', and then drawn in along the longitudinal axis. The at least one optically active element 7 preferably likewise has a very long design, in particular approximately or exactly as long as the cover 5. If a plurality of elements 7, 7' is to be connected to the cover 5, these can either be drawn in correspondingly one after the other or connected to one another initially and then drawn in together in the connected state.

Alternatively, the embodiment may be such that the at least one optically active element 7 can be inserted between the two connection regions 10, 10'.

The invention claimed is:

1. A cover for covering a light outlet opening delimited by a support rail of a lighting strip system, the support rail configured to receive a luminaire having a light source for producing light, the cover comprising:

a plate-shaped bearing region defining a planar bearing surface for supporting at least one optically active element, and a holding device separately formed from the bearing region, the holding device and the bearing region connected to each other via a mating connection to define a pocket for holding the at least one optically active element.

2. The cover as claimed in claim 1, wherein the cover is configured such that it can be rolled up into a roll.

3. The cover as claimed in claim 1, wherein the cover is configured to extend along a longitudinal axis and has a connection region for connecting to the support rail which abuts the bearing region on one side and extends parallel to the longitudinal axis, and wherein the holding device comprises a holding lip formed on the connection region.

4. The cover as claimed in claim 3, wherein the connection region is made of a material that is more flexible than a material making up the bearing region.

5. The cover as claimed in claim 3, wherein the holding lip extends towards the bearing surface.

6. The cover as claimed in claim 3, wherein the cover has a symmetrical design in respect of a central plane (M) extending parallel to the longitudinal axis and penetrating the bearing region, so that the cover has a further connection region with a corresponding further holding lip, said connection region being configured symmetrically to the aforementioned connection region.

7. The cover as claimed in claim 1, wherein the cover is configured as a profile part.

8. The cover as claimed in claim 1, wherein the cover is produced using a two-component injection-molding method.

9. The cover as claimed in claim 8, wherein the cover is configured in such a manner that the at least one optically active element can be inserted or introduced into the cover for an anticipated connection thereto.

10. An arrangement comprising:

the cover according to claim 1, and at least one optically active element, wherein the at least one optically active element is held on the cover by the holding device.

11. The arrangement as claimed in claim 10, wherein the optically active element is a film, which has an optically diffusing or light-directing effect.

12. The arrangement as claimed in claim 10, wherein the cover is configured to extend along a longitudinal axis and has a connection region for connecting to the support rail which abuts the bearing region on one side and extends parallel to the longitudinal axis, and wherein the holding device comprises a holding lip formed on the connection region; the cover having a symmetrical design in respect of a central plane (M) extending parallel to the longitudinal axis and penetrating the bearing region, so that the cover has a further connection region with a corresponding further holding lip, said connection region being configured symmetrically to the aforementioned connection region and wherein the optically active element is arranged lying on the bearing surface and is positioned on two opposite sides by the holding lip and the further holding lip or arranged pressed against the bearing surface.

13. A lighting strip system comprising:

a support rail extending along a longitudinal axis, an elongate luminaire which is arranged in the support rail, wherein the luminaire has a light source for producing light, wherein a light outlet opening through which the light passes is delimited by the support rail, an elongate, light-permeable cover extending along the longitudinal axis, which cover is arranged covering the light outlet opening, wherein the cover is configured according to claim 1.

14. The cover as claimed in claim 1, wherein the holding device includes two separately formed connection regions arranged on opposite ends of the cover.

15. The cover as claimed in claim 1, wherein the mating connection between the cover and the holding device includes at least one groove and at least one protrusion.

16. The cover as claimed in claim 1, wherein the holding device has a V-shaped profile, and a first end of the V-shaped profile includes a holding lip freely extending towards the bearing surface to engage the at least one optically active element, and a mating lip configured to mate with the cover.

* * * * *